US005853065A

United States Patent [19]

Hutson et al.

[11] Patent Number: 5,853,065

[45] Date of Patent: Dec. 29, 1998

[54] ADJUSTABLE LEG LADDER ASSEMBLY

[76] Inventors: Emory R. Hutson; Barbara J. Hutson, both of 7530 Lake Haven Dr., W., Wilmer, Ala. 36587

[21] Appl. No.: 942,056

[22] Filed: Oct. 1, 1997

[51] Int. Cl.[6] ..... E06C 7/00

[52] U.S. Cl. ..... 182/18; 182/204

[58] Field of Search ..... 182/200–205, 182/18, 129

[56] References Cited

U.S. PATENT DOCUMENTS

| | | | |
|---|---|---|---|
| 3,805,917 | 4/1974 | Luther | 182/200 |
| 4,249,638 | 2/1981 | Fernandez | 182/201 |
| 4,423,797 | 1/1984 | Batten | 182/204 |
| 4,456,095 | 6/1984 | Hodson | 182/200 |
| 4,671,383 | 6/1987 | Huang | 182/204 |
| 4,679,652 | 7/1987 | Cervantes, Sr. | 182/200 |
| 4,896,745 | 1/1990 | Wärnelöv | 182/200 |
| 4,993,514 | 2/1991 | Ferguson | 182/200 |
| 5,148,892 | 9/1992 | Lu | 182/201 |
| 5,181,584 | 1/1993 | Simard | 182/201 |
| 5,232,067 | 8/1993 | Griffith | 182/201 |
| 5,265,698 | 11/1993 | Friedel | 182/201 |
| 5,497,850 | 3/1996 | Patterson | 182/204 |
| 5,526,898 | 6/1996 | Clark | 182/200 |
| 5,542,497 | 8/1996 | Macyszyn | 182/201 |
| 5,547,412 | 8/1996 | Wilcox | 182/18 |

*Primary Examiner*—Alvin Chin-Shue
*Attorney, Agent, or Firm*—Joseph N. Breaux

[57] ABSTRACT

An adjustable leg ladder assembly that includes a collapsible A-frame ladder structure including a top plate, a forward ladder step support including two forward support legs, and a rear A-frame support including two rear support legs; left and right forward leg adjustment inserts each slidably and lockably positionable into one of the forward support leas of the forward ladder step support; left and right rear leg adjustment inserts each slidably and lockably positlonable into one of the rear support legs of the rear A-frame support; and a weight sensing unit including a sensor output conditioning circuit, four weight sensors and four output displays; each of the four weight sensors being installed into the underside surface of one of the pivoting foot pads; the sensor output conditioning circut being in electrical connection with each of the sensor outputs from each of the four weight sensors and in electrical connection with each of the display inputs of the four output displays; the conditioning circuit providing four drive signals, one for each of the output displays; each of the output displays displaying a weight value that corresponds with the weight supported by a corresponding one of the four pivoting foot pads that has the corresponding weight sensor installed therein.

7 Claims, 2 Drawing Sheets

ADJUSTABLE LEG LADDER ASSEMBLY

TECHNICAL FIELD

The present invention relates to ladders and more particularly to an adjustable leg ladder assembly that includes a collapsible A-frame ladder structure including a top plate, a forward ladder step support including a number of ladder rungs positioned between two forward support logs, and a rear A-frame support including two rear support legs; left and right forward leg adjustment inserts each slidably positionable into one of the forward support legs of the forward ladder step support and each including a number of locking pin holes, a locking pin, and a pivoting foot pad; left and right rear leg adjustment inserts each slidably positionable into one of the rear support legs of the rear A-frame support and each including a number of locking pin holes, a locking pin, and a pivoting foot pad; and a weight sensing unit including a sensor output conditioning circuit, four weight sensors and four output displays; each of the four weight sensors being installed into the underside surface of one of the pivoting foot pads; the sensor output conditioning circuit being in electrical connection with each of the sensor outputs from each of the four weight sensors and in electrical connection with each or the display inputs of the four output displays; the conditioning circuit providing four drive signals, one for each of the output displays, each of the output displays displaying a weight value that corresponds with the weight supported by a corresponding one of the four pivoting foot pads that has the corresponding weight sensor installed therein.

BACKGROUND ART

It is often necessary to position a ladder onto a surface that is not flat or than has a sloping contour. It would be an advantage in these situations to have a ladder having four independently adjustable legs that allowed a user to adjust the length of each leg of the ladder to conform to the contours of the surface supporting the ladder. In addition, because a user can tip a ladder over by shifting his/her weight when reaching away from the ladder, such as when painting, it would be a benefit to have a ladder that included four weight sensors and four weight display outputs, the weight display outputs displaying the weight supported on each of the legs to allow a user to judge when the ladder was in danger of tipping and when the ladder was evenly supported by all four legs.

GENERAL SUMMARY DISCUSSION OF INVENTION

It is thus an object of the invention to provide an adjustable leg ladder assembly that includes four independently adjustable legs.

It is a further object of the invention to provide an adjustable leg ladder assembly that includes four legs, four weight sensors and four weight display outputs, each of the four weight display outputs displaying the weight supported on a corresponding one of the four legs.

It is a still further object of the invention to provide an adjustable leg ladder assembly that includes a collapsible A-frame ladder structure including a top plate, a forward ladder step support including a number of ladder rungs positioned between two forward support legs, and a rear A-frame support including two rear support legs; left and right forward leg adjustment inserts each slidably positionable into one of the forward support legs of the forward ladder step support and each Including a number of locking pin holes, a locking pin, and a pivoting foot pad; left and right rear Leg adjustment inserts each slidably positionable into one of the rear support legs of the rear A-frame support and each including a number of locking pin holes, a locking pin, and a pivoting foot pad; and a weight sensing unit including a sensor output conditioning circuit, four weight sensors and four output displays; each of the four weight sensors being installed into the underside surface of one of the pivoting foot pads; the sensor output conditioning circuit being in electrical connection with each of the sensor outputs from each of the four weight sensors and in electrical connection with each of the display inputs of the four output displays; the conditioning circuit providing four drive signals, one for each of the output displays, each of the output displays displaying a weight value that corresponds with the weight supported by a corresponding one of the four pivoting foot pads that has the corresponding weight sensor installed therein.

It is a still further object of the invention to provide an adjustable Leg ladder assembly that accomplishes some or all of the above objects in combination.

Accordingly, an adjustable leg ladder assembly is provided. The adjustable leg ladder assembly includes a collapsible A-frame ladder structure including a top plate, a forward ladder step support including a number of ladder rungs positioned between two forward support legs, and a rear A-frame support including two rear support legs; left and right forward leg adjustment inserts each slidably positionable into one of the forward support legs of the forward ladder step support and each including a number of locking pin holes, a locking pin, and a pivoting foot pad; left and right rear leg adjustment inserts each slidably positionable into one of the rear support legs of the rear A-frame support and each including a number of locking pin holes, a locking pin, and a pivoting foot pad; and a weight sensing unit including a sensor output conditioning circuit, four weight sensors and four output displays; each of the four weight sensors being installed into the underside surface of one of the pivoting foot pads; the sensor output conditioning circuit being in electrical connection with each of the sensor outputs from each of the four weight sensors and in electrical connection with each of the display inputs of the four output displays; the conditioning circuit providing four drive signals, one for each of the output displays, each of the output displays displaying a weight value that corresponds with the weight supported by a corresponding one of the four pivoting foot pads that has the corresponding weight sensor installed thereon.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
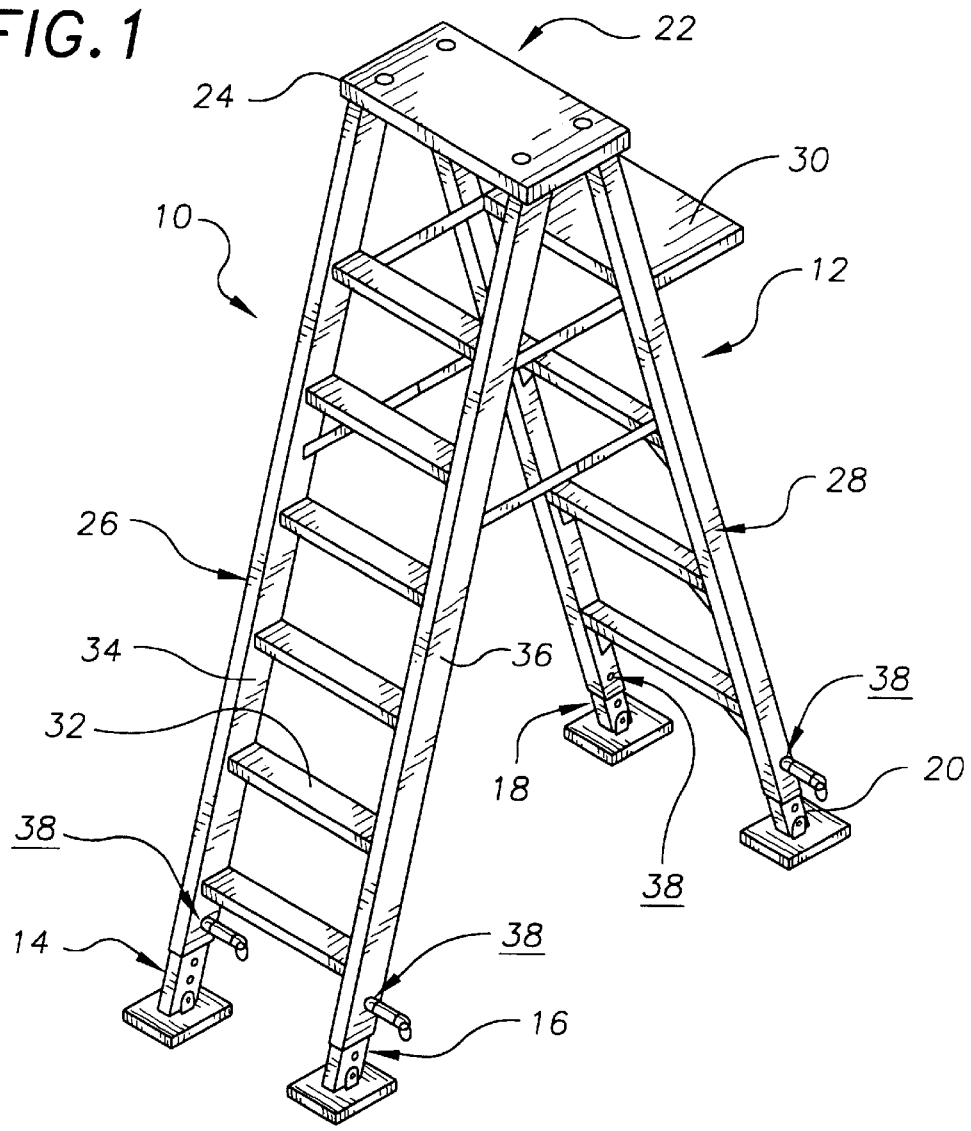
FIG. 1 is a perspective view of an exemplary embodiment of the adjustable leg ladder assembly of the present invention showing the collapsible A-frame ladder structure including the top plate, the forward ladder step support, the rear A-frame support, and the fold-out shelf; the left and right forward leg adjustment inserts each slidably positionable into one of the forward legs of the forward ladder step support and including a number of locking pin holes, a locking pin, and a pivoting foot pad; the left and right rear leg adjustment inserts each slidably positionable into one of the rear legs of the rear A-frame support and including a number of locking pin holes, a locking pin, and a pivoting foot pad; and the four dial type output displays of the weight sensing unit.

FIG. 1 shows an exemplary embodiment of the adjustable leg ladder assembly of the present invention generally designated by the numeral 10. In this embodiment, ladder assembly 10 includes a collapsible A-frame ladder structure, generally designated 12; left and right forward leg adjustment inserts, generally designated 14,16, respectively; left and right rear leg adjustment inserts, generally designated 18,20, respectively; and a weight sensing unit, generally designated 22.

Collapsible A-frame ladder structure 12 is of aluminum construction and includes a top plate 24; a forward ladder step support, generally designated 26; a rear A-frame support, generally designated 28; and a fold-out shelf 30. Forward ladder step support 26 includes five extruded aluminum ladder rungs 32 that are positioned between two hollow forward support legs, 34,36 that are constructed from rectangular cross-section aluminum tubing. A bottom of each forward support leg 34,36 is provided with a locking pin hole 38 (see also FIG. 2). A-frame support 28 is also of aluminum construction and includes two hollow, aluminum rear support legs 40,42 that are constructed from rectangular cross-section aluminum tubing. The bottom of each rear support leg 40,42 is also provided with a locking pin hole 38 (see also FIG. 2). Forward ladder step support 26 and A-frame support 28 are foldable in the conventional fashion for storage and transport of ladder structure 12.

Figure 2:
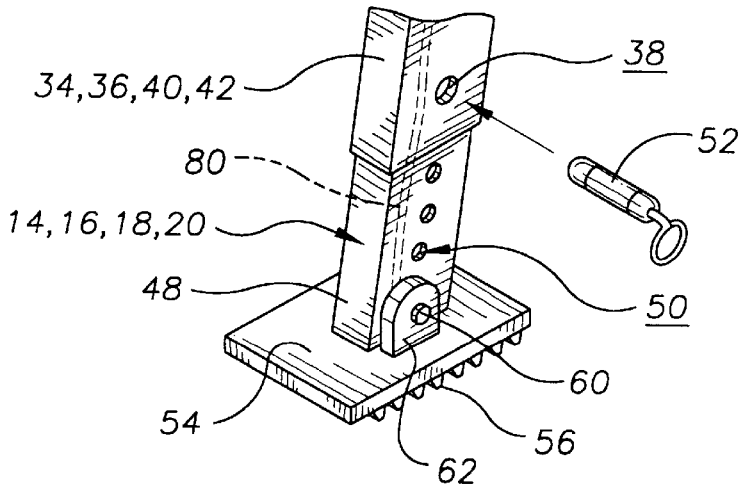
FIG. 2 is a detail perspective view of one of leg adjustment inserts showing a number of the locking pin holes, the locking pin and the pivoting foot pad.

In this embodiment, left and right forward leg adjustment inserts 14,16 and left and right rear leg adjustment inserts 18,20 are of identical construction and therefore, with reference now to FIG. 2, the discussion made in connection with the single insert 14,16,18,20, is equally applicable to each individual adjustment insert 14,16,18,20. Each adjustment insert 14,16,18,20 includes a tubular insert member 48 that is slidably into a hollow support leg 34,36,40,42 and that has a number of locking pin holes 50, a conventional steel locking pin 52, and a pivoting foot pad 54 that is provided with a resilient, ridged, anti-skid surface 56. Pivoting foot pad 54 is pivotably mounted to the end of insert member 52 by a pivot pin 60 positioned through two identical spaced pivot brackets 62 (only one shown).

Figure 3:
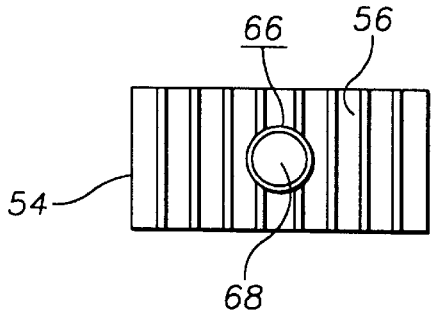
FIG. 3 is a plan view of the underside of one of the four identical pivoting foot pads showing the resilient, ridged, anti-skid surface and the weight sensor positioned through a circular hole formed through the anti-skid surface.

With reference FIG. 3, each resilient, ridged, anti-skid surface 56 of each pivoting foot pad 54 is constructed from ridged synthetic rubber and has a circular sensor opening 66 through which one of the four weigh sensors 68 of the weigh sensing unit 22 (FIG. 1) are installed.

Figure 4:
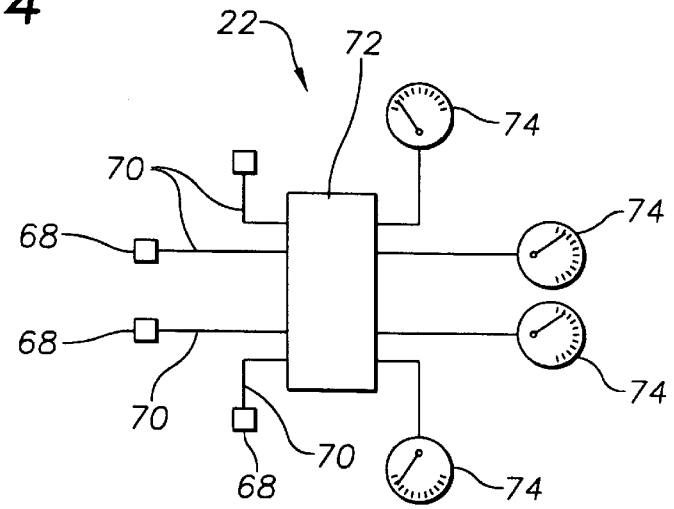
FIG. 4 is a schematic diagram of the weight sensing unit showing the sensor output conditioning circuit in connection with signal outputs of the four weight sensors and the four dial type output displays in connection with the four outputs of the sensor output conditioning circuit.
Figure 5:
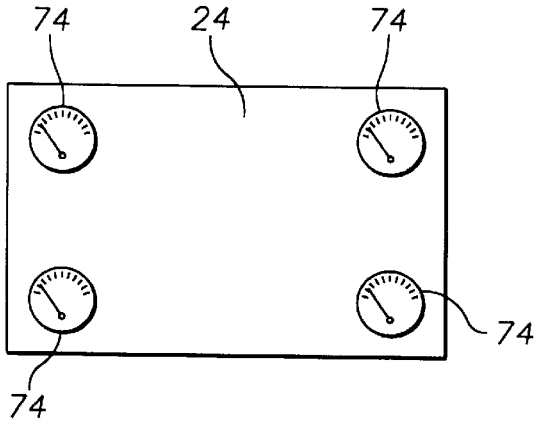
FIG. 5 is a top plan view of the top plate of the A-frame ladder structure of FIG. 1 with the four output displays installed into the four corners thereof.

With reference to FIG. 4, in this embodiment weight sensing unit 22 includes four conventional weigh sensors 68 that each have a sensor output 70 in electrical connection with a conventional signal conditioning circuit 72. Signal conditioning circuit 72 converts each of the relatively low level weight sensor output signals to a power level that is sufficient to drive one of the four conventional analog, ammeter deflector pin, output displays 74. Although deflector pin, output displays 74 are used in this embodiment, it should be understood that other types of displays, such as digital liquid crystal displays can be used without departing from the spirit and scope of the invention taught herein. With reference to FIG. 5, each of the output displays 74 is mounted into a corner of top plate 24. Each output display 74 indicates the weight supported by the pivoting foot pad 54 that corresponds with that corner of ladder structure 12. In this embodiment, signal conditioning circuit 72 is mounted to the underside of top plate 24 and weight sensors 68 (FIG. 3) are wired to signal conditioning circuit 72 by wires 80 (FIG. 2) that are each routed through a tubular insert member 48 (FIG. 2) and a support leg 34,36,40,42.

It can be seen from the preceding description that an adjustable leg ladder assembly has been provided that includes four independently adjustable legs; that includes four legs, four weight sensors and four weight display outputs, each of the four weight display outputs displaying the weight supported on a corresponding one of the four legs; and that includes a collapsible A-frame ladder structure including a top plate, a forward ladder step support including a number of ladder rungs positioned between two forward support Legs, and a rear A-frame support including two rear support legs; left and right forward leg adjustment inserts each slidably positionable into one of the forward support legs of the forward ladder step support and each including a number of locking pin holes, a locking pin and a pivoting foot pad; left and right rear leg adjustment inserts each slidably positionable into one of the roar support legs of the rear A-frame support and each including a number of locking pin holes, a locking pin, and a pivoting foot pad; and a weight sensing unit including a sensor output conditioning circuit four weight sensors and four output displays; each of the four weight sensors being installed into the underside surface of one of the pivoting foot pads; the sensor output conditioning circuit being in electrical connection with each of the sensor outputs from each of the four weight sensors and in electrical connection with each of the display inputs of the four output displays; the conditioning circuit providing four drive signals, one for each of the output displays, each of the output displays displaying a weight value that corresponds with the weight supported by a corresponding one of the four pivoting foot pads that has the corresponding weight sensor Installed therein.

It is noted that the embodiment of the adjustable leg ladder assembly described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An adjustable leg ladder assembly comprising:

a collapsible A-frame ladder structure including a top plate, a forward ladder step support including a number of ladder rungs positioned between two forward support legs, and a rear A-frame support including two rear support legs;

left and right forward leg adjustment inserts each slidably positionable into and lockable with respect to one of said forward support legs of said forward ladder step support, each left and right forward leg adjustment insert including a number of locking pin holes, a detachable locking pin, and a pivoting foot pad;

left and fight rear leg adjustment inserts each slidably positionable into and lockable with respect to one of said rear support legs of said rear A-frame support, each left and right rear leg adjustment insert including a number of locking pin holes, a detachable locking pin, and a pivoting foot pad; and a weight sensing unit including a sensor output conditioning circuit, four weight sensors and four output displays;

each of said pivoting foot pads having one of said four weight sensors installed into an underside surface thereof;

said sensor output conditioning circuit being in electrical connection with a sensor output from each of said four weight sensors and in electrical connection with a display input of each of said four output displays;

said conditioning circuit providing four separate drive signals, one to each of said four output displays;

each of said four output displays displaying a weight value that corresponds with a weight supported by a corresponding one of said four pivoting foot pads;

each said underside surface of each said pivoting foot pad having a resilient, ridged, anti-skid surface provided thereon, each anti-skid surface having a sensor opening through which one of said four weigh sensors of said weigh sensing unit is installed.

2. The adjustable leg ladder assembly of claim 1, wherein:

said A-frame ladder structure includes a fold-out shelf.

3. The adjustable leg ladder assembly of claim 1, wherein:

each of said four output displays is an analog, ammeter deflector pin, output display.

4. The adjustable leg ladder assembly of claim 1, wherein:

said top surface is rectangular in shape and has four corners; and one of said four display outputs is positioned into one of said corners of said top plate.

5. The adjustable leg ladder assembly of claim 2, wherein:

each of said four output displays is an analog, ammeter deflector pin, output display.

6. The adjustable leg ladder assembly of claim 2 wherein:

said top surface is rectangular in shape and has four corners; and one of said four display outputs is positioned into one of said corners of said top plate.

7. The adjustable leg ladder assembly of claim 3 wherein:

said lop surface is rectangular in shape and has four corners; and one of said four display outputs is positioned into one of said corners of said top plate.

* * * * *